United States Patent [19]

Wisotzki

[11] Patent Number: 4,949,642

[45] Date of Patent: Aug. 21, 1990

[54] FUNNEL OR BOWL SHAPED INSERT FOR HOLLOW CHARGES AND METHOD AND MOULD FOR ITS PRODUCTION

[76] Inventor: Jürgen Wisotzki, Weserstrasse 7a, 6074 Rödermark, Fed. Rep. of Germany

[21] Appl. No.: 640,144

[22] Filed: Jun. 29, 1984

[30] Foreign Application Priority Data

Jul. 2, 1983 [DE] Fed. Rep. of Germany ..... 3323991

[51] Int. Cl.[5] ..... F42B 1/02

[52] U.S. Cl. ..... 102/307; 102/308; 102/476

[58] Field of Search ..... 102/306–310, 102/476

[56] References Cited

U.S. PATENT DOCUMENTS 4,551,287 11/1985 Bethmann ..... 102/307 X 4,598,643 7/1986 Skrocki ..... 102/307 X

*Primary Examiner*—Peter A. Nelson

*Attorney, Agent, or Firm*—Larson and Taylor

[57] ABSTRACT

The funnel- or bowl-shaped insert for hollow charges consists of a hollow body (10) which is produced and shaped from a copper monocrystal obtained through crystal growth. The growth orientation is the (111) main orientation. It coincides with the longitudinal axis of the hollow body. For production using the Bridgman zone melting process a mould is proposed consisting of an inner and outer mould section (18, 20). Both mould sections may be moved axially in relation to each other and will be brought into their terminal position determined by stop (26) during the melting process.

14 Claims, 2 Drawing Sheets

Figure 1:
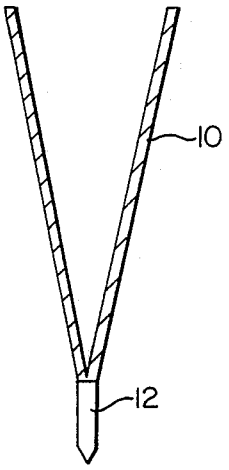

FUNNEL OR BOWL SHAPED INSERT FOR HOLLOW CHARGES AND METHOD AND MOULD FOR ITS PRODUCTION

The invention covers a funnel- or bowl-shaped insert for hollow charges as well as a method and a mould for their manufacture.

Hollow charge ammunition is used against armour plates and has been known for a long time. Primarily responsible for the effect of a hollow charge is the funnel- or bowl-shaped insert which normally is made of copper and is placed ahead of the charge. When the hollow charge impacts upon an armour plate, the insert generates a heat sting resulting in perforation of armour.

In order to focus the hollow charge energy to generate the so-called 'sting', a critical element will be the behaviour of the funnel- or bowl-shaped insert under the forces and temperatures to which it is exposed. Hitherto one has sought to eliminate internal strains and inhomogenities by carefully selected materials and reliance upon suitable conventional production methods. This inventions aims at providing a hollow charge insert, superior to the state of the art, doing away with inhomogenities and malfunctions to a high degree of reliability.

According to this invention the above objective is met in that the insert is made of a hollow body formed from a copper monocrystal shaped by crystal growth.

A pure monocrystyal does not give rise to inhomogenitites as may be caused in the case of electrolytic copper by grain boundaries and residual impurities. It may therefore be of interest to replace conventionally used electrolytic copper by a base material made from monocrystal which will then be processed by mechanical or deep-drawing methods. By contrast, this invention proposes to go one step further and to allow the monocrystal to grow in such a way that it will embody the desired funnel- or bowl-shape of the insert from the outset. In this simple manner it will be possible to eliminate with absolute certainty not only the structural inhomogenities but also irregularities induced by mechanical treatment.

In the preferred application of this invention, the (111) main orientation of the monocrystal is aligned with the longitudinal axis of the hollow body. The (111) growth direction of the monocrystal ensures optimal sliding and shaping behaviour of the material in the direction of the longitudinal axis.

For the manufacture of this new insert it is proposed that starting from a nucleus crystal a copper monocrystal is drawn from the melt in a mould corresponding to the funnel- or bowl-shaped hollow body and that the nucleus crystal is thereafter separated. The monocrystal is preferably drawn from the center of the outside surface of the bottom of the funnel- or bowl-shaped hollow body. In principle it is possible to use the Bridgman zone melting process for making monocrystals.

In order to obtain monocrystals of high quality it is important that the process steps of melting and solidification into a monocrystal follow in close sucession. In order to produce from a monocrystal a hollow body which is thin-walled in relation to its size, as needed for hollow charge inserts, it was found surprisingly of advantage to apply high-frequency induction or resistance heating in the vicinity of the nucleus crystal and thence to displace the melt into the mould section which shapes the peripheral wall of the funnel- or bowl-shaped hollow body.

A characteristic feature of a mould suitable for the aforementioned manufacturing method is that is composed of an outer mould section, shaping the external surface of funnel- or bowl-shaped hollow body, and an inner mould section which can be moved axially relative to the external mould section, the inner or outer mould section enclosing a chamber open towards the shaping surface for receiving the nucleus crystal.

In order to minimize mould costs, particularly when different hollow bodies are to be produced, this invention may be refined further by subdividing one of the mould sections into two sections the first of which containing the mould for the funnel- or bowl-shaped hollow body and the second containing a cavity for receiving the monocrystal. The mould sections may be graphite crucibles which are held within a quartz tube.

For good dimensional accuracy the inner mould section is guided radially on the external mould section and may be inserted into the latter down to a terminal position limited by a reciprocal axial stop.

Further detail is provided by reference to the following illustrations.

Figure 2:
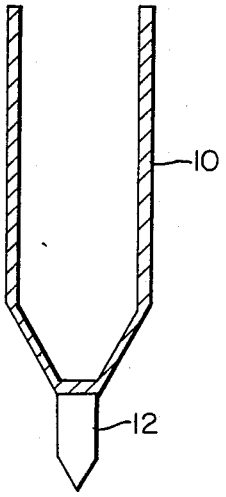
Figure 3:
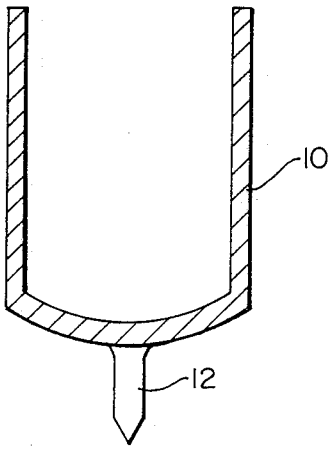
Figure 4:
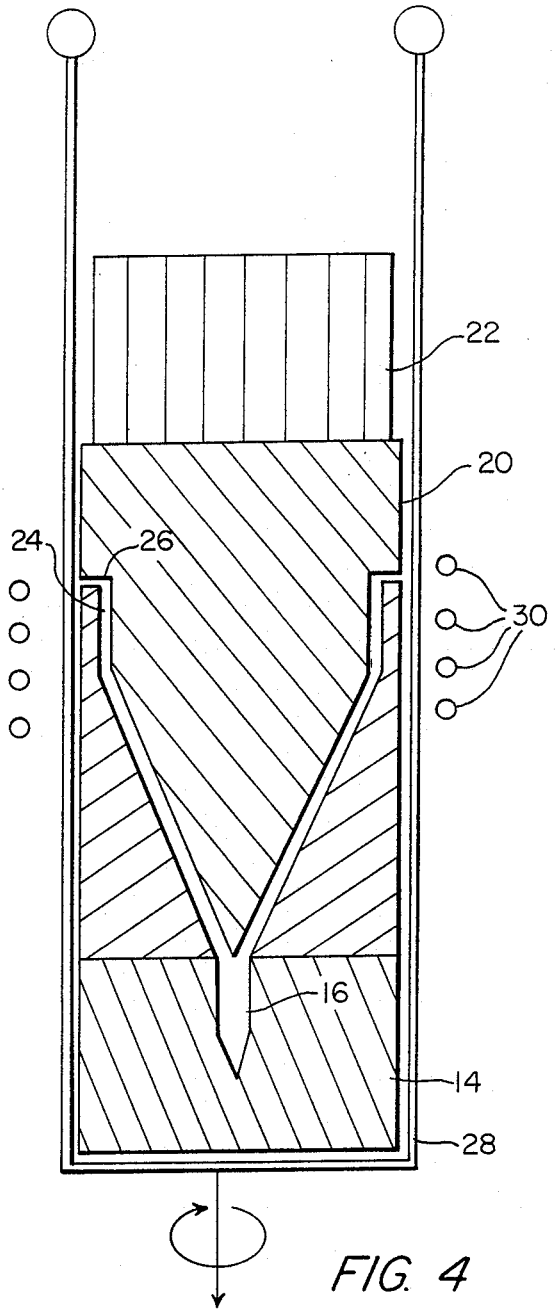

FIGS. 1 to 3 show three different configurations of hollow bodies produced according to this invention FIG. 4 represents a cross-section through a device for producing monocrystals in the shapes of the type illustrated in FIGS. 2 to 3.

Axial cross-sections through various hollow bodies shown in FIGS. 1 to 3 are to demonstrate that the method described here permits production of practically any shape for hollow charge inserts. These inserts may be shaped like a funnel, as in FIG. 1, or a hollow cylinder, as in FIG. 2, with a hollow cone stump closed at one end, or, as in FIG. 3, like a cylindrical bowl with its bottom curved outwards. In all of these configurations the monocrystal hollow bodies are grown from a nucleus crystal 12 which is separated subsequently by mechanical means from hollow body 10. As illustrated in the figure the nucleus crystal 12 is invariably located in the center of the hollow body's closed bottom on its outside surface. By selecting the main orientation for the lattice of nucleus crystal 12 at that surface where crystal growth is initiated the orientation of the monocrystal as a whole is determined.

The mould shown in FIG. 4 for preparing monocrystals in the shape of a funnel- or bowl-shaped hollow body consists in the illustrated case of three crucible sections. The section designated 14 encloses a cavity 16 for receiving the nucleus crystal 12. Firmly and closely located on the lower mould section 14 or, alternatively, forming one piece with the former, is an external mould section 18 whose shaping surface will form the outer surface of hollow body 10. The inner surface of hollow body 10 is determined by the inner shaping section 20 which is capable of being moved axially relative to the outer mould section 18 and which, for the arrangement shown, of mould sections 14,18, 20 on top of each other is loaded by weight 22.

For guiding and positioning of the inner mould section 20 relative to the outer mould section 18, both are provided with fitting peripheral sliding surfaces 24 and interacting axial stop surfaces 26. The peripheral sliding surfaces ensure centering of mould sections 18, 20 whereas the axial stop surfaces 26 determine the terminal position down to which the inner mould section 20 may be inserted into the outer mould section 18. This, in turn, governs the wall thickness of the funnel-or bowl-shaped hollow body to be produced in the mould.

Mould sections 14, 18, 20 may be of graphite and are held within quartz tube 28. The latter is provided with lugs, at its upper end, by means of which it may be attached to a lowering spindle and lowered slowly during the manufacturing process while the mould is moved axially through a high-frequency coil 30 which constitutes a heating zone in this illustrated example.

When a monocrystal hollow body 10 is produced a nucleus crystal 12 is inserted into cavity 16 and a quantity of copper sufficient for making the hollow body 10 is loaded into the outer mould section 18. As the next step the inner mould section 20 is lowered from the top into the outer mould section 18 until the lower tip of the inner mould section 20 begins to rest on the copper under its own weight, loaded if necessary by weight 22.

Following this, the mould is inserted into the activated high-frequency coil in such a manner that the copper will melt. Due to the liquefaction of the material the inner mould section 20 will drop down further under its own weight and that of weight 22 driving the molten metal upwards and to the outside. This process takes place merely under the impetus of the heat effect. In the terminal position the two mould sections 18 and 20 will be in contact with their axial stop surfaces 26 and the inner mould cavity between the two cone-shaped moulding surfaces of mould sections 18 and 20 will be filled with melt up to a predetermined level.

While the mould is being lowered relative to the high-frequency coil the melt will begin to cool in the area of the active upper surface of nucleus crystal 12 in cavity 16 and the developing crystal lattice is aligned to the orientation in the nucleus crystal. Crystal growth then progresses in the funnel-shaped cavity of the mould from the bottom upwards while the mould is lowered further. It is preferable to slowly rotate the mould during lowering as indicated by the arrow in the drawing.

The melting of metal and drawing of monocrystals from the surface of a nucleus crystal in the manner outlined above using a crucible moved through a heated zone is known in principle as the Bridgman zone melting process for making monocrystals; there is thus no need to cover theis in greater detail. The novel feature, however, is the manufacture of hollow bodies in the manner described and the composition of the mould.

The hollow body 10 which is formed directly during the growing of the monocrystal is characterised by the homogeneous structure of its texture and by absence of internal strains. Given this homogeneity and the dimensional accuracy achieved already during the crystal growth phase, which obviates subsequent machining that may give rise to internal stresses, the monocrystal hollow bodies produced according to this method are well suited as inserts for hollow charges that will deform regularly under pressure.

I claim:

1. A funnel- or bowl-shaped insert for hollow charges, wherein the improvement comprises an insert constituting of a hollow body formed by crystal growth of a copper monocrystal drawn from a melt in a mould starting from a nucleus crystal, the inner and outer surfaces of the insert being directly formed by corresponding shaping surfaces of the mould.

2. An insert as claimed in claim 1, wherein the main orientation of the monocrystal is aligned with the longitudinal axis of the hollow body.

3. A method for producing a funnel- or bowl-shaped insert for hollow charges wherein the insert consists of a hollow body having inner and outer surfaces, using a mould having shaping surfaces which define the shape of the insert, said method comprising, starting from a nucleus crystal, drawing a copper monocrystal from a melt in a said mould so as to form a said funnel- or bowl-shaped insert the inner and outer surface of which, in the final form thereof, are directly shaped by the shaping surfaces of the mould and subsequently separating the nucleus crystal from the insert so formed.

4. A method as claimed in claim 3, wherein the monocrystal is drawn from the center of the outside surface of the bottom of the funnel- or bowl-shaped hollow body.

5. A method as claimed in claim 3, wherein the monocrystal is produced by the Bridgman zone melting process.

6. A method as claimed in claim 3, wherein the melt is produced by high-frequency induction or resistance heating in the vicinity of the nucleus crystal and is displaced from that location into that part of the mould which shapes the peripheral wall of the funnel- or bowl-shaped hollow body.

7. A mould for implementing a method for producing a funnel- or bowl-shape insert for hollow charges wherein th insert consists of a hollow body and said method comprises, starting from a nucleus crystal, drawing a copper monocrystal from the melt and subsequently separating the nucleus crystal, said mould comprising an outer mould section for directly shaping the final external surface of the funnel- or bowl-shaped hollow body, and an inner mould section for directly shaping the final inner surface of the hollow body, said inner mould section being movable axially relative to the outer mould section, and the inner and outer mould sections enclosing a cavity open towards its shaping surface for receiving the nucleus crystal.

8. A mould as claimed in claim 7, wherein one of the mould sections, is subdivided into a first section, containing the mould cavity for the funnel- or bowl-shaped hollow body, and a second section containing a cavity for receiving the nucleus crystal.

9. A method as claimed in claim 7, wherein the inner mould section can be inserted into the outer mould section down to a terminal position limited by a reciprocal axial stop.

10. A method as claimed in claim 7, the distinguishing feature being that the inner mould section is guided radially at the outer mould section.

11. A mould as claimed in claim 7, wherein the inner mould section is positioned vertically above the outer mould section and is loaded by a weight.

12. A mould as claimed in claim 7, wherein the mould sections are graphite crucibles held within a quartz tube.

13. A mould as claimed in claim 7, wherein the mould can be moved axially and rotated relative to a heater element surrounding the mould.

14. A method for producing a funnel- or bowl-shaped insert for hollow charges wherein the insert comprises a hollow body having inner and outer surfaces, using a mould having at least two relatively movable mould parts which include shaping surfaces that form the inner and outer surfaces of the insert and which are relatively movable between an open position of the mould and a final, closed position thereof, said method comprising providing relative movement of said mould parts to an open position to enable receipt of a solid copper monocrystal therein prior to melting of the monocrystal and thereafter providing relative movement of the mould, during melting of the copper monocrystal, to the closed position thereof, wherein the shaping surfaces of the mould parts precisely define the final inner and outer surfaces of the insert.

* * * * *